US006460627B1

(12) United States Patent
Below et al.

(10) Patent No.: US 6,460,627 B1
(45) Date of Patent: Oct. 8, 2002

(54) DRILLING AND/OR CHISELING DEVICE

(75) Inventors: Armin Below, Kaufering; Hans-Werner Bongus-Ambrosius, Munich; Martin Richter, Freising; Thomas Hofbrucker, Mammendorf; Kent Karlsson, Pöcking, all of (DE)

(73) Assignee: Hilti Aktiengesellschaft, Schaan (LI)

( * ) Notice: Subject to any disclaimer, the term of this patent is extended or adjusted under 35 U.S.C. 154(b) by 118 days.

(21) Appl. No.: 09/712,586

(22) Filed: Nov. 14, 2000

(30) Foreign Application Priority Data

Nov. 18, 1999 (DE) ..... 199 55 412

(51) Int. Cl.[7] ..... E02D 7/06
(52) U.S. Cl. ..... 173/48; 173/109
(58) Field of Search ..... 173/48, 109, 201, 173/104, 128, 200, 210, 212, 216

(56) References Cited

U.S. PATENT DOCUMENTS 3,799,275 A * 3/1974 Plattenhardt et al. ..... 173/48
4,073,348 A * 2/1978 Schramm et al. ..... 173/109
4,325,436 A * 4/1982 Richter et al. ..... 173/118
4,418,766 A * 12/1983 Grossmann ..... 173/13
4,446,931 A * 5/1984 Bleicher et al. ..... 173/109
4,719,976 A * 1/1988 Bleicher et al. ..... 173/109
5,277,259 A * 1/1994 Schmid et al. ..... 173/109
5,373,905 A * 12/1994 Bleicher et al. ..... 173/109
5,379,848 A * 1/1995 Rauser ..... 173/109
5,447,205 A * 9/1995 Thurler ..... 173/13
RE35,372 E * 11/1996 Houben et al. ..... 173/109
5,653,294 A * 8/1997 Thurler ..... 173/13
5,787,996 A * 8/1998 Funfer ..... 173/104
5,975,217 A * 11/1999 Frenzel et al. ..... 173/109
5,992,541 A * 11/1999 Frenzel et al. ..... 173/109

* cited by examiner

*Primary Examiner*—Scott A. Smith
*Assistant Examiner*—Nathaniel Chukwurah
(74) *Attorney, Agent, or Firm*—Sidley Austin Brown & Wood, LLP

(57) ABSTRACT

A drilling and/or chiseling device has a drive spindle (19) for a drilling and/or chiseling tool with two ring gears (17, 18) of different sizes, a countershaft (1) with a drive pinion (15), a wobble drive (7) for a striking mechanism, mounted on the countershaft (1), and a switching sleeve (9), mounted on the countershaft (1) so that it can be shifted axially by a switching element (20). The switching element displaces the switching sleeve (9) into four different modes of operation of the drilling and/or chiseling device.

8 Claims, 4 Drawing Sheets

DRILLING AND/OR CHISELING DEVICE

FIELD OF INVENTION

The invention relates to a drilling and/or chiseling device with a drive spindle for a tool with a countershaft parallel to the drive spindle, a drive pinion rotationally connected to the countershaft and interacts in rotational engagement with a power take-off pinion of a drive motor. A wobble drive for a striking mechanism mounted on the countershaft with a switching sleeve positioned on the countershaft for axial displacement by a switching element.

BACKGROUND INFORMATION AND PRIOR ART

For working on concrete, stone, masonry, or the like, a drilling and/or chiseling device with a drive spindle for a drilling and/or chiseling tool, driven by a drive motor, as well as a striking mechanism, which is connected with the drive spindle, strikes the drilling and/or chiseling tool with axial strokes, by means of the drive spindle, is known from German patent 33 22 963. Parallel to the drive spindle, there is a further spindle, which can be connected with the drive motor and has a drill chuck, which serves to hold a drilling tool, which can only be used for drilling work without impact strokes. This additional spindle can be driven at a higher rotational speed than can the drive spindle.

A ring gear is connected with the drive spindle and with the further spindle, in each instance, so that there is no mutual rotation. The ring gear, which is disposed on the drive spindle, has a diameter greater than that of the ring gear, which is disposed on the additional spindle. These two ring gears can be connected rotationally engaged over a gear mechanism with a power take-off pinion of the drive motor.

The gear mechanism of the drilling and/or chiseling device has a countershaft arranged parallel to the two spindles, with a drive pinion that interacts rotationally connected with the power take-off pinion of the drive motor. On the countershaft, there is a wobble drive for a striking mechanism, mounted rotationally engaged. A switching sleeve, which can be axially shifted using a switching element is also connected rotationally engaged with the countershaft. This switching sleeve has an orbiting collar with an orbiting groove, into which a selector fork of the switching element extends. Two different modes of operation of the drilling and/or chiseling device can be set using the switching sleeve. In a first mode of operation, a first gear ring interacts rotationally connected with a counter ring gear of the wobble drive and the ring gear of the drive spindle. In a second mode of operation, the switching sleeve interacts rotationally engaged only with the ring gear of a further spindle.

The limited usability of this drilling and/or chiseling device is considered to be a very great disadvantage, since only two different modes of operation can be set. In a first mode of operation, the drive spindle has a low rpm and the activated wobble drive has a high wobbling frequency. In a second mode of operation, the drive spindle has a high rpm and the wobble drive is not activated. In particular, a good drill hole quality and good holding values for fastening elements, for example, in the form of dowels, in a receiving material made up of hollow bricks, for example, which have a large number of hollow chambers, cannot be achieved with this drilling and/or chiseling device. The progress of drilling when drilling without impact—the second mode of operation—is very slow, and because of the high rpm of the further spindle, as well as because of the high friction between the drill tip and the receiving material, the drill tip of the drilling tool wears out. In addition, the impact strength cannot be varied with this drilling and/or chiseling tool, accordingly, when working on the aforementioned masonry composed of fired bricks, it can be expected that the walls that define the hollow chambers will be shattered, so that they can no longer serve to fix the fastening elements.

OBJECT OF THE INVENTION

It is an object of the invention to provide a drilling and/or chiseling device, which can be operated easily and safely and can be used in many different ways, and with which very good progress of drilling can be achieved and for which the impact energy can be varied while the rpm of the drive spindle remains constant.

SUMMARY OF THE INVENTION

These objectives are accomplished with a drilling and/or chiseling device that has the distinguishing features of two outer ring gears on the countershaft that it is possible a first outer ring gear is meshed in rotational engagement with a ring gear on the switching sleeve and the outer ring gear is meshed with a further ring gear connection for rotation with the drive spindle For the inventive drilling device, four different modes of operation can be set:

- first mode of operation: low rpm of the drive spindle; wobble drive activated, with a high wobbling frequency;
- second mode of operation: low rpm of the drive spindle; wobble drive not activated;
- third mode of operation: low rpm of the drive spindle; wobble drive activated, with a low wobble frequency; and
- fourth mode of operation: high rpm of the drive spindle; wobble drive not activated.

These modes of operation can be set using the switching sleeve, which can be moved axially relative to the countershaft and shifted into four different positions along the countershaft using the switching lever. The rotational movement of the countershaft is transferred over the two outer ring gears, on the one hand, directly to the switching sleeve and, on the other, directly to the further ring gear of the drive shaft. Since the second outer ring gear is always rotationally engaged with the further ring gear of the drive spindle in the first, second, and third modes of operation, the drive spindle is rotated at a uniform rpm in these three different modes of operation. A first ring gear of the switching sleeve, which is constructed as an inner ring gear also remains rotationally engaged in all three modes of operation with the counter-ring gear of the wobble drive, which is structured as an outer gear arrangement. In order for this to be possible, the axial length of the counter-ring gear corresponds to the axial length of the first ring gear and to the total path, by which the switching sleeve can be shifted in one direction.

With the help of the switching sleeve, a rotational connection between the countershaft and the wobble drive is brought about in the first mode of operation. In this connection, a second ring gear of the switching sleeve, which is constructed as an inner ring gear, interacts in a rotationally engaged manner with the first outer ring gear of the countershaft. Since the switching sleeve is rotationally connected directly with the first outer ring gear, the speeds of rotation of the countershaft and the wobble drive are the same. The wobble drive has a high wobbling frequency.

To set the second mode of operation for the inventive drilling and/or chiseling device, the switching sleeve is shifted along the countershaft by one position, in the working or drilling direction. In this connection, the rotational connection between the second ring gear of the switching sleeve and the first outer ring gear of the countershaft is severed, so that the rotational movement of the countershaft is no longer transferred to the switching sleeve and from the latter to the wobble drive.

In order to be able to achieve a lesser wobbling frequency and, therefore, a lower impact energy in the third mode of operation than in the first mode of operation, it is necessary to reduce the rpm of the wobble drive. This is achieved with the help of the switching sleeve, which interacts in rotational engagement with the ring gear of the drive spindle in the third mode of operation. The further ring gear of the drive spindle is connected for rotation with the second outer ring gear on the countershaft. In order to be able to achieve a lower rpm of the switching sleeve, the further ring gear, which interacts with the countershaft, advisably has a diameter larger than that of the ring gear, which can be connected rotationally with the switching sleeve. In the third mode of operation, the second ring gear, which is disposed in the interior of the switching sleeve, is not connected rotationally engaged with the countershaft.

For manufacturing reasons, the switching sleeve advantageously has a third ring gear that can be brought into a rotational connection with the smaller ring gear.

In order to be able to keep the switching path of the switching sleeve as short as possible, the ring gear advantageously is disposed between the first ring gear and the switching sleeve.

In order to create a rotational connection between the first ring gear of the switching sleeve and the first outer ring gear of the countershaft, the outer ring gear advisably is constructed as large as the counter-ring gear of the wobble drive.

To keep the overall length of the drilling and/or chiseling device as short as possible, the two ring gears are constructed as a modular unit, in which the two ring gear are disposed coaxially and at a short distance from one another.

For the purpose of achieving a high rpm at the drive spindle in the fourth mode of operation without activating the wobble drive, the countershaft, the switching sleeve and the driving spindle interact rotationally engaged. To be able to disengage the large ring gear of the modular unit from the second outer ring gear of the countershaft, the modular unit advantageously can advisably be shifted with the help of the switching element along the driving spindle in the working direction counter to the force of a spring.

Precise shifting of the switching sleeve along the countershaft and of the two ring gears along the driving spindle is ensured in that preferably the switching element has a selector fork and a stop facing in the working direction. The selector fork engages a groove of a collar on the switching sleeve. The stop can be connected with a face of the second ring gear facing counter to the working direction. The switching element is connected, for example, with a control knob that can be actuated outside of the drilling and/or chiseling device and with the help of which the four different modes of operation can be set. For example, a cam is disposed between the control knob and the switching element and converts the rotational movement of the button into a longitudinal movement acting on the switching element.

The invention is explained in greater detail below by means of drawings showing an embodiment of the invention.

DETAILED DESCRIPTION OF THE INVENTION

Figure 1:
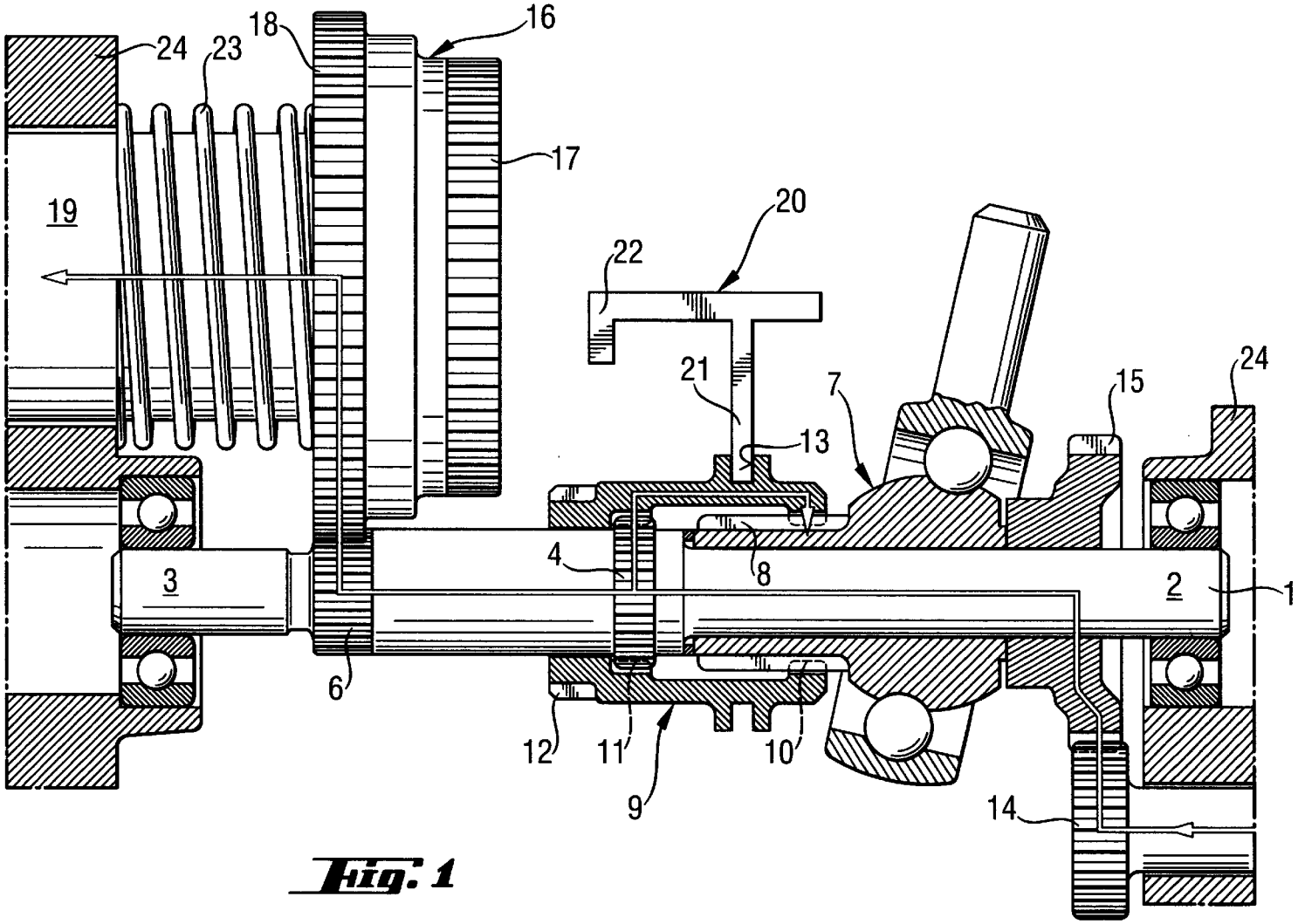
FIG. 1 shows an inventive gear mechanism for a drilling and/or chiseling device in a first mode of operation; with low rpm of the chive spindle, and the wobble drive activated with a high wobbling frequency.

The gear mechanism in FIGS. 1 to 4 of a drilling and/or chiseling device, the details of which are not shown, has a countershaft 1, which is rotatably mounted by means of two bearings 2, 3, located in the opposite end regions of the countershaft 1, in corresponding counter-bearings of a housing 24. A drive motor, not shown, drives the countershaft 1. The power take-off pinion 14 of the drive motor interacts in a rotationally engaged manner with a drive pinion 15, which is connected rotationally with the countershaft 1. A wobble drive 7, which is rotatably mounted on the countershaft 1, adjoins the drive pinion 15 in the working direction.

The wobble drive 7 has an essentially cylindrical projection in an end region on the working side. The outer contour of the projection is provided with counter gear teeth 8. The drive pinion 15 and the wobble drive 7 are located on a first section of the countershaft 1, which has a diameter smaller than that of second forward section. In the working direction, the second section with the larger diameter adjoins the first section. This second section of the countershaft 1 is provided with two outer ring gears 4, 6, a first outer ring gear 4, closer to the wobble drive 7, corresponds to the counter-gear teeth 8 of the wobble drive 7.

A switching sleeve 9, surrounding the countershaft 1, can be moved along the countershaft 1, and has a first ring gear 10 in the form of an inner ring gear in an end region opposite the working direction. This ring gear 10 can be connected rotationally with the counter-gear teeth 8 of the wobble drive 7 or with the first outer ring gear 4 of the countershaft. On the inside, the switching sleeve 9 has a second ring gear 11, which corresponds to the first ring gear 10. The second ring gear 11 is disposed at a distance from the first ring gear 10. In an end region facing in the working direction, the switching sleeve 9 is provided with an outer third ring gear 12. The switching sleeve 9 can be shifted along the countershaft 1 with the help of a switching element 20. A selector fork or gear shift 21 of the switching element 20 protrudes into an orbiting groove 13 of an orbiting collar on the switching sleeve 9. The switching element 20 is provided with a stop 22 that faces in the working or drilling direction, and can connected with a part 16 which, with a face pointing counter to the working direction, can be connected with two ring gear 17, 18 on joint 16. The switching element 20 is shifted, for example, by means of a control knob (not shown) on the outside of a housing 24 of the drilling and/or chiseling device, the control knob interacts, for example, by means of a cam, with the switching element 20.

A drive shaft 19 for the drilling and/or chiseling tool, not shown, is positioned parallel to and spaced laterally from the countershaft 1 and seated in an appropriate bearing of the housing 24. A striking mechanism, not shown, is disposed coaxially to the drive shaft 19, and can be driven by the wobble drive 7 for delivering axial impacts on the drilling and/or chiseling tool, which can be connected with the drive shaft 19. The part 16, which has two axially spaced ring gears 17, 18, is rotationally connected to the drive shaft 19. However, it can be shifted along the drive spindle 19 in the working direction, counter to the force of a spring 23. The two ring gears 17, 18 have different diameters. The larger ring gear 18 is connected in the first, second and third modes of operation rotationally engaged with the second outer ring gear 6 of the countershaft 1.

In the first mode of operation as shown in FIG. 1, the wobble drive 7 is activated with the help of the switching sleeve 9, which interacts with the first ring gear 10 rotationally meshed with the counter-gear teeth 8 of the wobble drive 7, and with the second ring gear 11, rotationally engaged with the first outer ring gear 4 of the countershaft 1.

Figure 2:
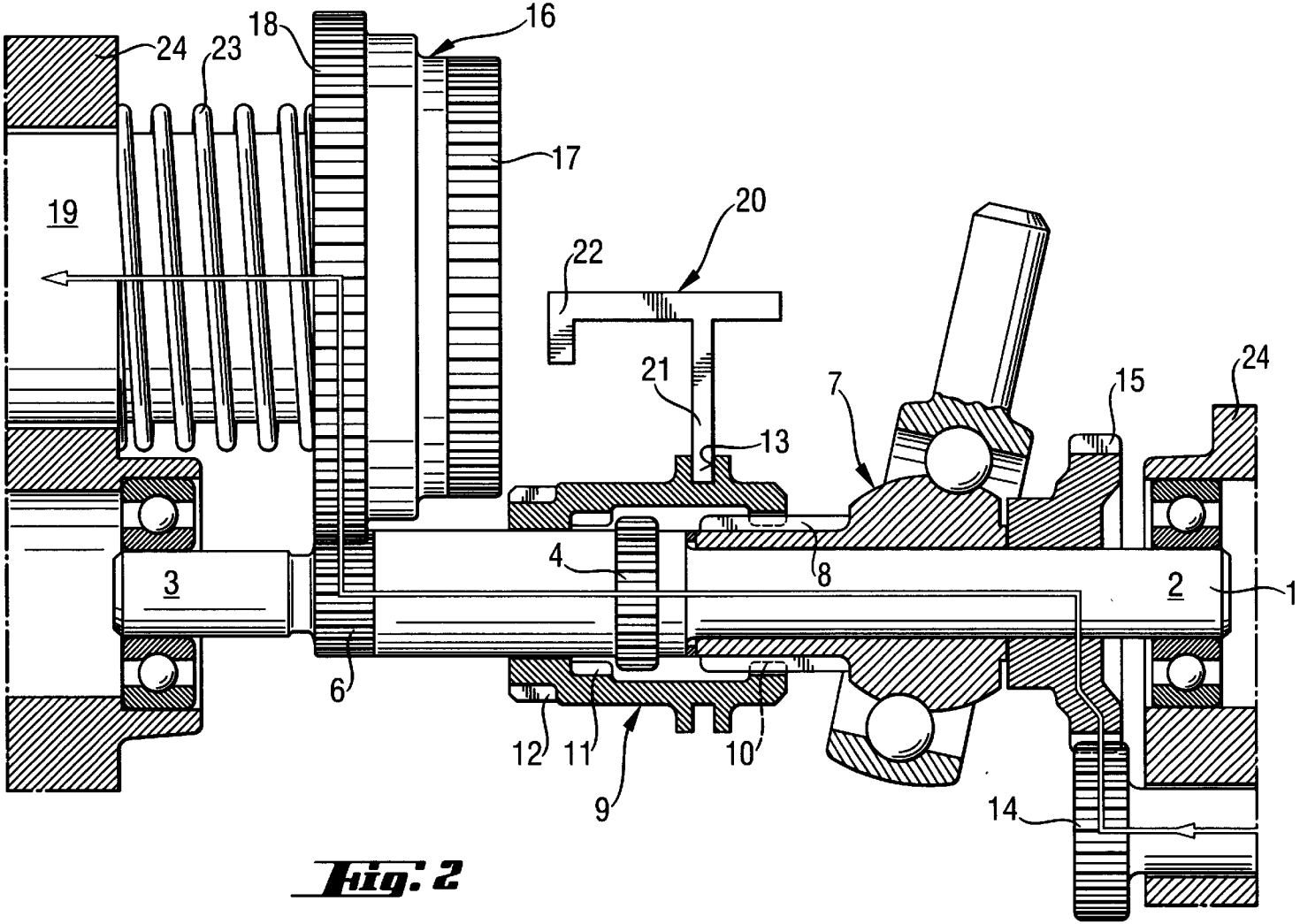
FIG. 2 shows the drilling and/or chiseling device of FIG. 1 in a second mode of operation; with low rpm of the drive spindle; and the wobble drive not activated.

In the second mode of operation of FIG. 2, the wobble drive is not activated, since the second ring gear 11 is no longer rotationally engaged with the first outer ring gear 4 on the countershaft 1. Admittedly, the first ring gear 10 of the switching sleeve 9 still engages the countering gear 8 of the wobble drive 7.

Figure 3:
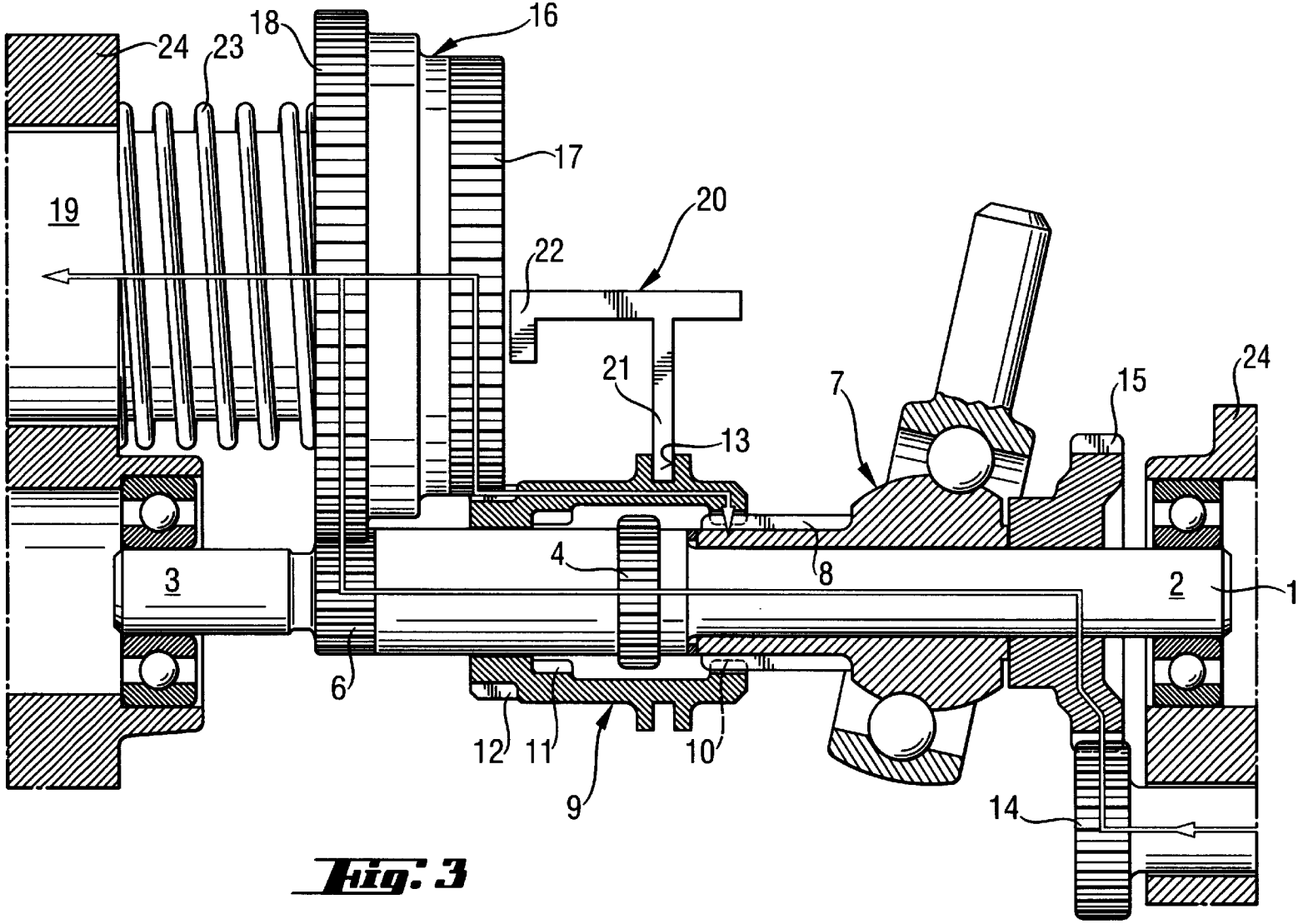
FIG. 3 shows the drilling and/or chiseling device of FIG. 1 in a third mode of operation; with low rpm of the drive spindle; and the wobble drive activated, with a low wobbling frequency.

In the third mode of operation in FIG. 3, the switching sleeve 9 is axially displaced over the smaller ring gear 17 on the part or modular unit 16, which interacts rotationally meshed with the third ring gear 12 of the switching sleeve 9. The first ring gear 10 of the switching sleeve 9 interacts rotationally engaged with the counter-gear teeth 8 of the wobble drive 7. Because of the different translations between the second outer ring gear 6 and the further ring gear 18 on part 16, as well as between the ring gear 17 and the third ring gear 12, the speed of the rotational movement, acting on the wobble drive 7 is less than the rotational speed of the countershaft 1. This results in a lower wobbling frequency and, with that, in lesser impact energy of the striking mechanism.

Figure 4:
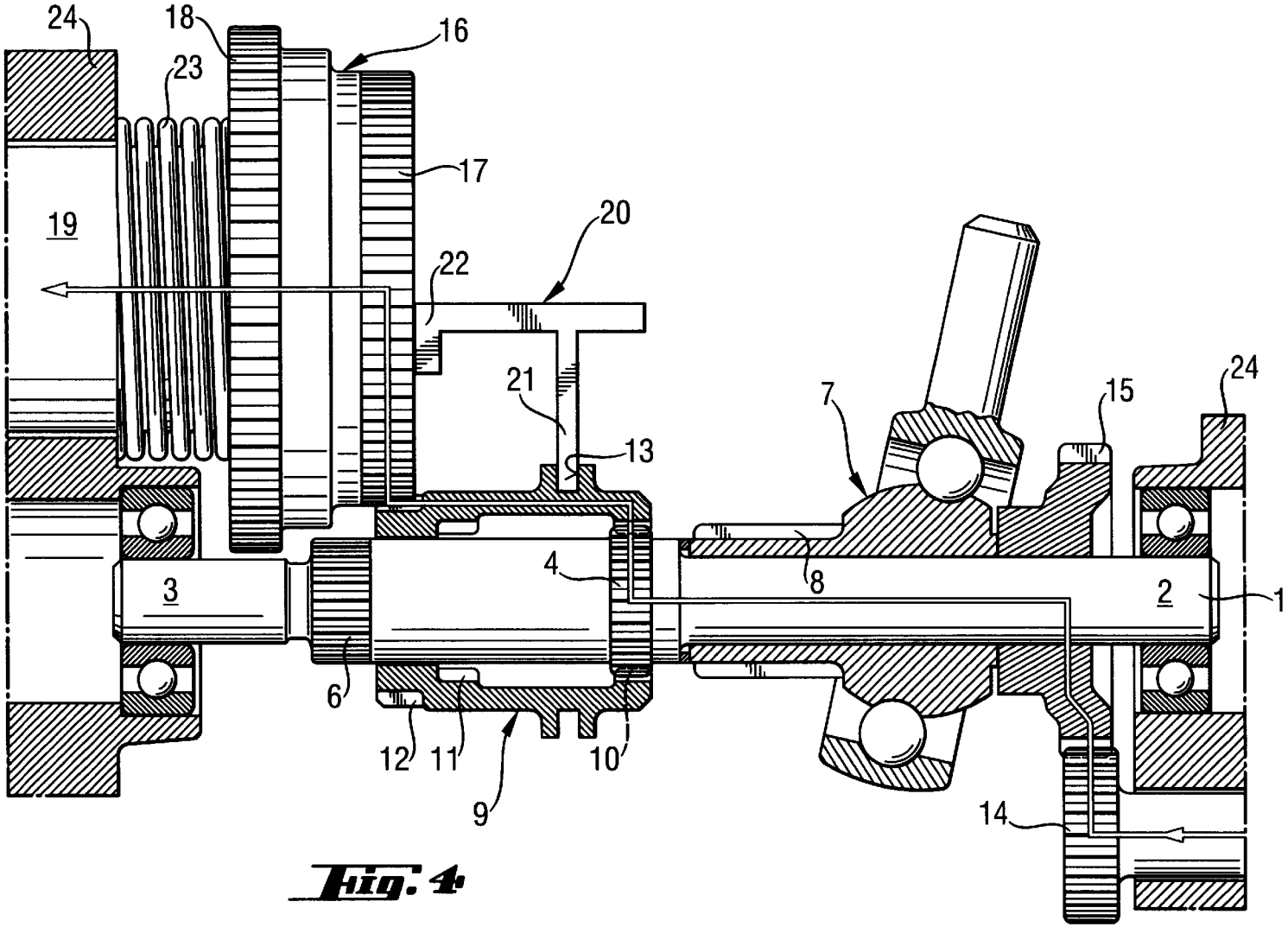
FIG. 4 shows the drilling and/or chiseling device of FIG. 1 in a fourth mode of operation; with high rpm of the drive spindle; and the wobble drive not activated.

In the fourth mode of operation in FIG. 4, the wobble drive is no longer activated. The first ring gear 10 of the switching sleeve 9 interacts rotationally engaged with the first outer ring gear 4 of the countershaft 1. The third ring gear 12 of the switching sleeve 9 is rotationally engaged with the second ring gear 17, and the whole modular unit 16 is shifted with the help of the switching element 20 in the working direction counter to the force of the spring 23. The ring gear 18 does not engage the second outer ring gear 6 of the countershaft 1.

What is claimed as new and desired to be protected by Letters Patent is set forth in the appended claims:

1. A drilling and/or chiseling device comprises a drive spindle (19) for a tool, a countershaft (1), arranged parallel to the drive spindle (19), a drive pinion (15), connected rotationally engaged with the countershaft (1) and rotationally engaged with a power take-off pinion (14) of a drive motor, a wobble drive (7) for a striking mechanism mounted on said countershaft (1), a switching sleeve (9) is mounted on the countershaft (1) and can be shifted axially with the help of a switching element (20) and said switching sleeve can be rotationally engaged by a first ring gear (10) thereon with corresponding counter-gear teeth (8) of said wobble drive (7), and first ring gear (17) mounted on a part (16) axially aligned with and rotationally engaged with the drive spindle (19), said countershaft (1) has two outer ring gears (4, 6), with a first outer ring gear (4) rotationally engaged with a second ring gear (11) of the switching sleeve (9), and a second outer ring gear (6) rotationally engaged with a second ring gear (18) on said part (16) and is connected in rotational engagement with the drive spindle (19).

2. A drilling and/or chiseling device, as set forth in claim 1, wherein the diameter of the second ring gear (18) on said part (16) is larger than the diameter of the first ring gear (17) thereon in rotationally engagement with the switching sleeve (9).

3. A drilling and/or chiseling device, as set forth in claim 1, wherein the switching sleeve (9) has a third ring gear (12) for effecting rotational engagement between the switching sleeve (9) and the first ring gear (17) on said part (16).

4. A drilling and/or chiseling device, as set forth in claim 3, wherein the first ring gear (17) is disposed between the second ring gear (18) on said part (16) and the switching sleeve (9).

5. A drilling and/or chiseling device, as set forth in claims 1 or 2, wherein the first outer ring gear (4) is constructed identically with the counter-ring teeth (8) of the wobble drive (7).

6. A drilling and/or chiseling device, as set forth in claims 1 or 2, wherein the first and second gear ring (17, 18) on part (16) form a modular unit (16).

7. A drilling and/or chiseling device, as set forth in claim 6, wherein the modular unit (16) can be axially shifted along the drive spindle (19) by said switching element (20) in the working direction counter to the force of a spring (23).

8. A drilling and/or chiseling device, as set forth in claim 7, wherein the switching element (20) has a selector fork (21) and a stop (22), facing in the working direction, the selector fork (21) engages a groove (13) in a collar of the switching sleeve (9), and said stop (22) is displaceable into contact with a face of the modular unit (16), directed counter to the working direction.

* * * * *